United States Patent [19]

Ushio et al.

[11] Patent Number: 5,024,189

[45] Date of Patent: Jun. 18, 1991

[54] ENGINE UNIT

[75] Inventors: Sadakatsu Ushio, Otsu; Noboru Nakamura, Kyoto; Hirofumi Higashi, Kameoka; Masataka Iwata, Handa; Fumiyasu Niwa, Nagoya, all of Japan

[73] Assignee: Mitsubishi Jidosha Kogyo Kabushiki Kaisha, Tokyo, Japan

[21] Appl. No.: 471,945

[22] Filed: Jan. 29, 1990

[30] Foreign Application Priority Data

Jan. 31, 1989 [JP] Japan ..... 1-10701[U]

[51] Int. Cl.[5] ..... F02F 7/00

[52] U.S. Cl. ..... 123/195 R; 123/195 H

[58] Field of Search ..... 123/195 R, 195 C, 195 H, 123/198 E

[56] References Cited

U.S. PATENT DOCUMENTS 4,721,077 1/1988 Fukuo et al. ..... 123/195 R 4,773,366 9/1988 Seidl et al. ..... 123/195 C

*Primary Examiner*—Noah P. Kamen

*Attorney, Agent, or Firm*—Hedman, Gibson, Costigan & Hoare

[57] ABSTRACT

An engine unit includes a cylinder block of a short-skirt type which has a plurality of first partition walls and a plurality of crank journals formed on the partition walls and rotatably receiving the crankshaft. Bearing caps are fitted to the crank journals and rotatably hold the crankshaft in cooperation with the crank journals. A lower case is fixed to the cylinder block and covers the crankshaft. The lower case includes a pair of flanges abutting against the lower edges of the skirt portions, a semi-cylindrical bottom wall, and a plurality of second partition walls formed on the bottom wall to oppose the first partition walls. Each bearing cap is clamped between the first and second partition walls. The lower case is fixed to the cylinder block by means of first bolts screwed into the skirt portions through the flanges, and second bolts screwed into the crank journals through the second partition walls and bearing caps.

9 Claims, 11 Drawing Sheets

ENGINE UNIT

BACKGROUND OF THE INVENTION

1. Field of the Invention

This invention relates to an engine unit, and more particularly to an engine unit having a cylinder block and a lower case fixed to the lower portion of the cylinder block.

2. Description of the Related Art

Recently large-capacity engines are manufactured by die-casting in aluminum. Hence, they are light and mass-produced. It is desired that these engines make as less noise as possible and withstand as great a load as possible. In particular, a V-type engine must withstand a great oblique load. The bearing caps used in the V-type engine are therefore made of cast iron. They are fastened by bolts to the crank journals of a cylinder block.

There has been known cylinder blocks of a longskirt type in which bearing caps are connected together by means of beams or bed plates or fastened to the skirts by side bolts, so as to prevent the bearing caps from inclining and to enhance their rigidity. However, the longskirt type cylinder block is rather massive, making it difficult to laying out a starter, an oil filter, a 4WD transmission, and the like, neatly within a limited space. Further, the rigidity of the caps is insufficient and inclination of the caps cannot be suppressed as much as desired.

In order to eliminate the problems resulting from the long-skirt type cylinder block, a short-skirt type cylinder block having a lower case has been developed. With this cylinder block, bearing caps made of cast iron are set firm in the lower case as the lower case is diecast in aluminum In this case, the bearing caps are sufficiently rigid indeed, but it takes much time to cast the bearing caps in the lower case, inevitably making it difficult to mass-produce engines.

SUMMARY OF THE INVENTION

This invention has been contrived in consideration of the above-mentioned situation, and its object is to provide an engine unit which is suited for mass production and in which the rigidity of the bearing caps can be enhanced.

In order to achieve this object, an engine unit according to the present invention comprises a cylinder block having a plurality of first partition walls and a plurality of crank journals formed on the partition walls and rotatably receiving a crankshaft, a plurality of bearing caps fitted to the crank journals and rotatably holding the crankshaft in cooperation with the crank journals, and a lower case fixed to the lower end of the cylinder block and covering the crankshaft. The lower case has a bottom wall and a plurality of second partition walls formed on the bottom wall to oppose the first partition walls. Each bearing cap is clamped between the first and second partition walls. The lower case is fixed to the cylinder block by a plurality of fixing means. Each fixing means includes first fastening members fastening a couple of first and second partition walls and the bearing cap to one another, and a pair of second fastening members fastening the cylinder block and the lower case to each other. The first and second fastening members are arranged in a common plane perpendicular to the axis of the crankshaft.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

FIGS. 1 to 16 show an engine unit according to an embodiment of the present invention, in which:

FIG. 1 is a cross-sectional view of the unit;

FIG. 2 is a top plan view of a lower case of the imot'

FIG. 3 is a bottom view of the lower case;

FIG. 4 is a cross-sectional view of a different portion of the unit from that of FIG. 1;

FIG. 5 is a cross-sectional view taken along the line C—C in FIG. 1;

FIG. 6 is a cross-sectional view taken along the line B—B in FIG. 2;

FIG. 7 is a cross-sectional view taken along the line D—D in FIG. 2;

FIG. 8 is a cross-sectional view taken along the line E—E in FIG. 2;

FIG. 9 is a cross-sectional view taken along the line F—F in FIG. 2;

FIG. 10 is a cross-sectional view taken along the line G—G in FIG. 2;

FIG. 11 is a cross-sectional view taken along the line H—H in FIG. 2;

FIG. 12 is a cross-sectional view taken along the line I—I in FIG. 2;

FIG. 13 is a plan view of an oil pan used of the unit; FIG. 14 is a side view of the oil pan;

FIG. 15 is a partially broken side view of the lower case; and

FIG. 16 is a front view of the lower case;

FIGS. 17A to 17D show a sealing structure of a conventional engine unit, in which:

FIG. 17A is a bottom view of a cylinder block with a small capacity;

FIG. 17B is a bottom view of a cylinder block with a large capacity;

FIG. 17C is a front view of a flywheel; and

FIG. 17D is a longitudinal sectional view of the unit; and

FIGS. 18A to 18C show a sealing structure of the engine unit according to the embodiment, in which:

FIG. 18A is a bottom view of the cylinder block;

FIG. 18C is a longitudinal sectional view of the unit.

DETAILED DESCRIPTION OF THE PREFERRED EMBODIMENT

This invention will be explained by way of an embodiment with reference to the accompanying drawings.

Figure 1:
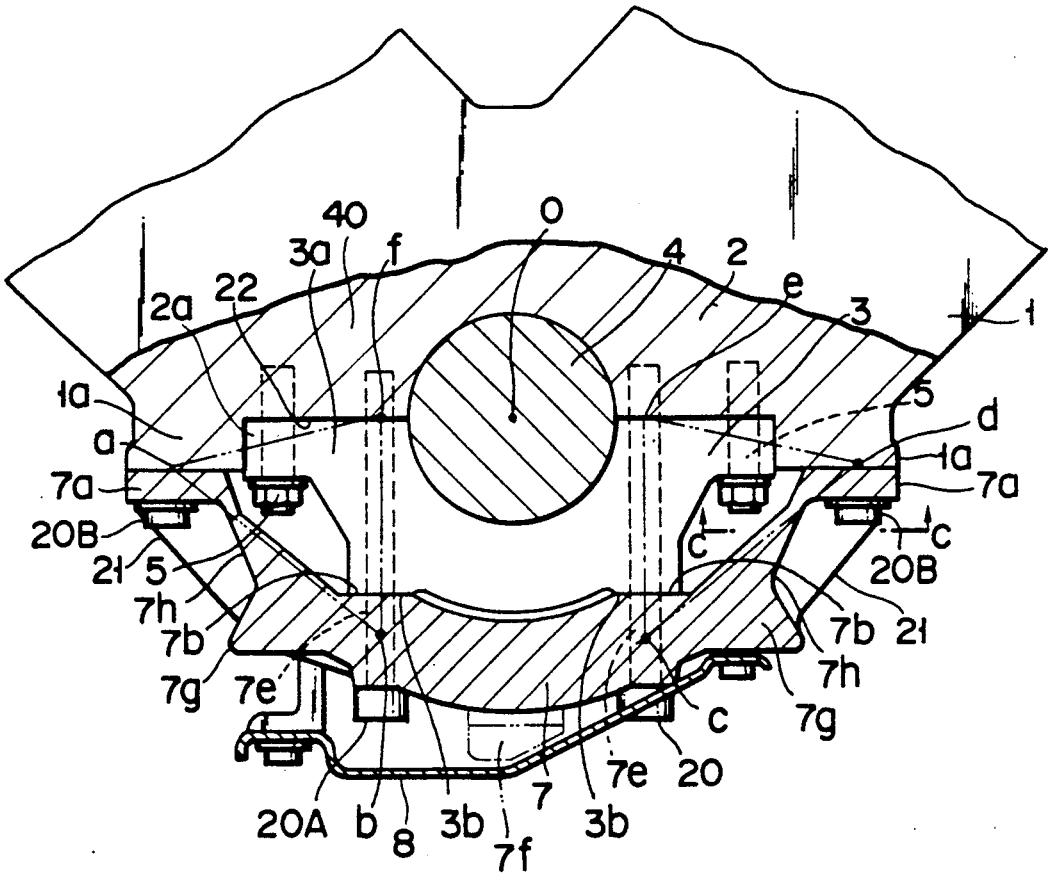

FIG. 1 shows an essential part of an engine unit of this invention. The engine unit is provided with a cylinder block 1 of a short-skirt type, made of aluminum, a lower case 7 fixed to the lower end of the block 1, and an oil pan 8 fixed to the lower face of the lower case 7. The cylinder block 1 has a plurality of first partition walls 40 and a plurality of crank journals 2 formed on the partition walls and rotatably receiving the main journals of a crankshaft 4. Each crank journal 2 has a substantially horizontal fitting face 22 lying on a plane including the central axis 0 of the crankshaft 4. The block 1 has a pair of skirt portions 1*a*, as side wall, which are located on both sides of the crankshaft 4 in parallel therewith The skirt portion 1*a* slightly projects downward from the fitting face 22 to define a fitting depression 2*a* along with the fitting face 22. As described later, the lower case 7 is fixed to the lower edges of the skirt portions 1*a*, which serve later as first flanges.

An engaging portion 3*a* of a bearing cap 3 made of cast iron is fitted in the fitting depression 2*a* of each crank journal 2. Each main journal of the crankshaft 4 is rotatably held between the cap 3 and the crank journal 4. Each cap 3 is screwed to the crank journal 2 by a pair of cap bolts 5, e.g., short reamer studs, disposed on both lateral sides of the crankshaft 4. The lower surface 3*b* of each cap 3 is located lower than the lower edges of the skirt portions 1*a* and extends in parallel to the fitting face 22.

The lower case 7 has a semi-cylindrical bottom wall 7*h*, a pair of parallel flanges 7*a*, and a plurality of second partition walls 7*b* formed on the upper surface of the depressed central portion of the lower case 7 and facing the crank journals 2, respectively. The flanges 7*a* abut against the lower edges of the skirt portions 1*a*, and each second partition wall 7*b* abuts against the lower surface 3*b* of the corresponding cap 3. The lower case 7 is fixed to the block 1 by means of a plurality of bolts 20B screwed to the skirt portions 1*a* passing through the flanges 7*a* from the lower side of the lower case 7. Further, the lower case 7 is fastened to the block 1 with being lapped over the caps 3, by means of a plurality of fixing bolts 20A, comprising long cap bolts, screwed in the crank journals 2 passing through the partition walls 7*b* and the caps 3 from the lower side of the lower case 7. Two fixing bolts 20A are prepared for each crank journal 2 and are arranged on both lateral sides of the crankshaft 4.

Since the lower case 7 is fixed to the crank journal 2 with being lapped over the caps 3 by means of the fixing bolts 20A, the distance between the fitting face 2*a* and the partition wall 7*b* can be large. This reduces the moment generated from the gas pressure and acting on the caps to incline the same to the axis of the crankshaft. (This moment will be referred to "moment of inclination.") As a result, the angle of inclination of the caps 3 is decreased.

This phenomenon is clearly understood from the following equation:

$$M = P \cdot L$$

where M is the moment of inclination generated in the cap 3, P is the gas pressure load exerted on the cap 3, and L is the distance between the fitting face 2*a* of the crank journal 2 and the partition wall 7*b* of the lower case 7. When M is constant, a larger L makes a smaller load P in an inverse proportional relation.

For each crank journal 2, the cap bolts 5 for fixing the cap 3 to the crank journal 2, the fixing bolts 20A for fixing the lower case 7 together with the cap 3 to the crank journal 2, and the fixing bolts 20B for fixing the flanges 7*a* of the lower case 7 to the skirt portions la are arranged in a common plane perpendicular to the central axis 0 of the crankshaft 4. Further, each point of action, on which the fastening force of the bolt is exerted, is reinforced by the later described ribs. Since each bolt of the lower case 7 is located on the load centralized plane with respect to the displacement direction of the cap 3 in which the gas pressure load is applied to the cap, the points a, b and f and the points c, d and e constitute truss structures, respectively. Accordingly, the lower portion of the cylinder block 1 has an extremely high rigidity.

A concrete structure of the lower case 7 will be described with reference to FIGS. 2 through 12.

Each flange 7*a* is formed with a plurality of bolt holes 7*d* through which the fixing bolts 20B pass, and each partition wall 7*b* is formed with a pair of bolt holes 7*e* which the fixing bolts 20A penetrate. A central rib 7*f* is provided on the lower portion of the lower case 7, and a side rib 7*g* is formed between each flange 7*a* and the partition walls 7*b*, such that these ribs extend in the axial direction of the crankshaft 4. The ribs 7*g*, 7*f* and the flanges 7*a* (in other words, the partition walls 7*b* and the flanges 7*a*) are coupled with one another by the bottom wall 7*h*.

Figure 5:
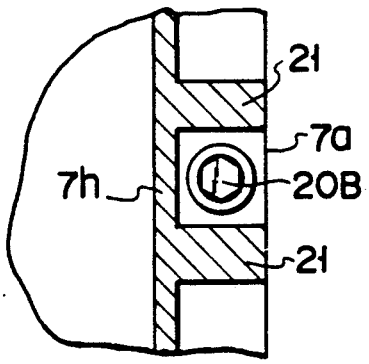
Figure 4:
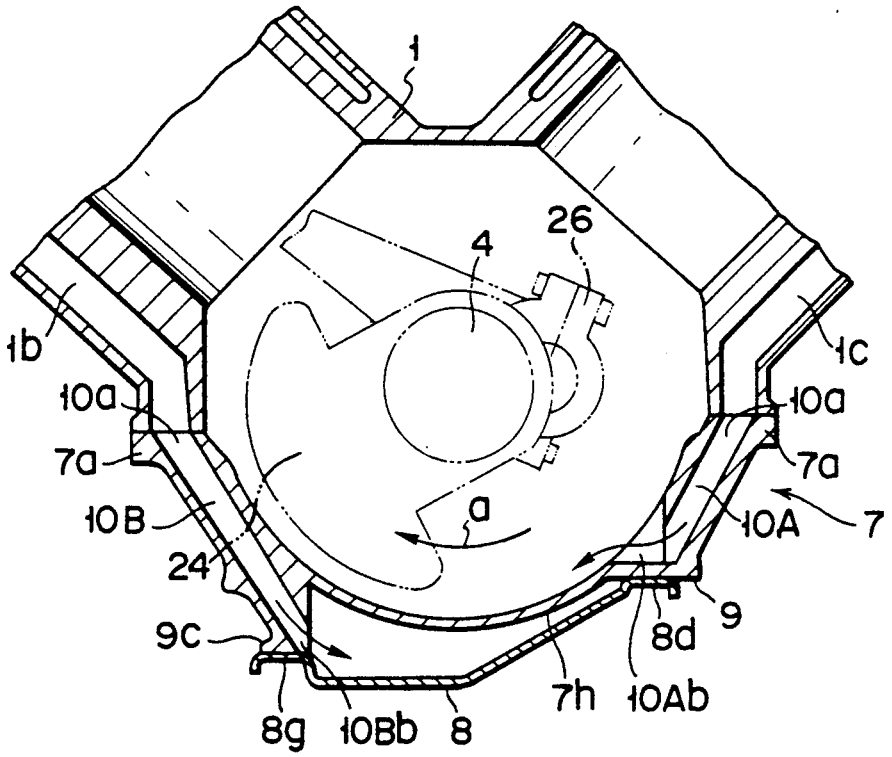
Figure 6:
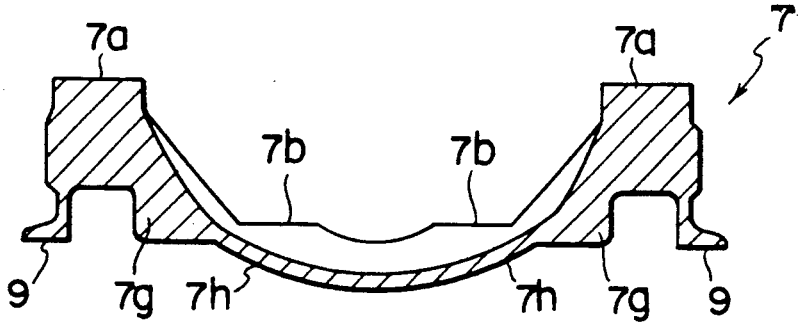
Figure 7:
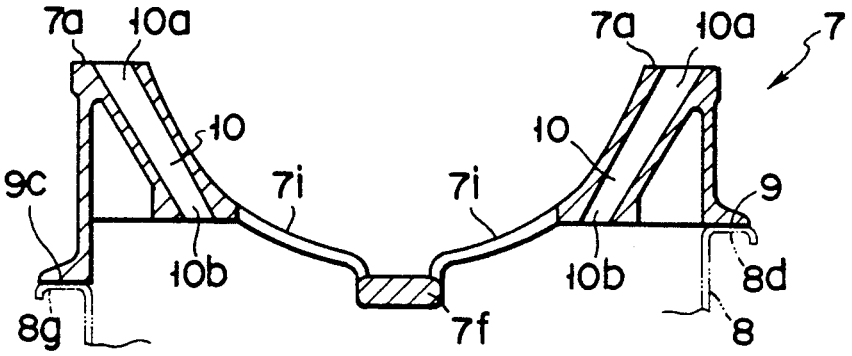
Figure 8:
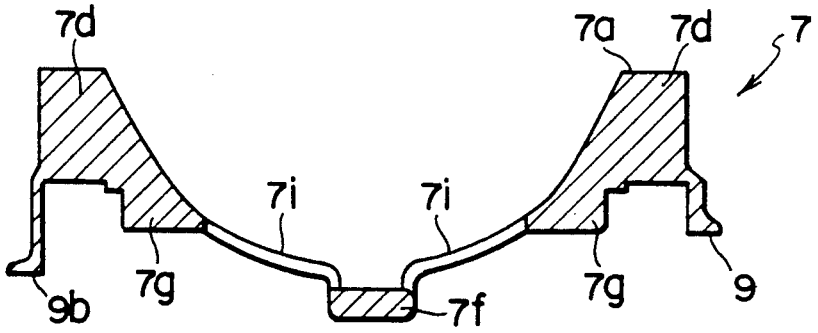
Figure 9:
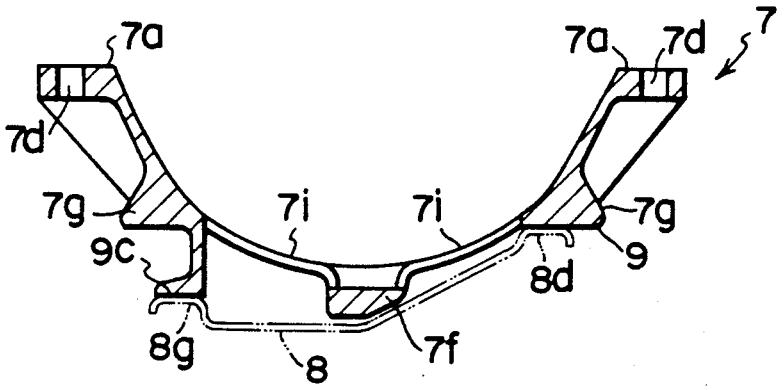
Figure 10:
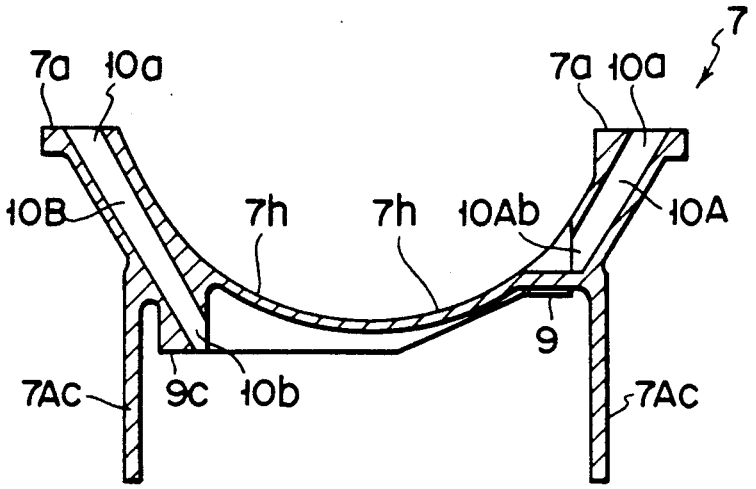
Figure 11:
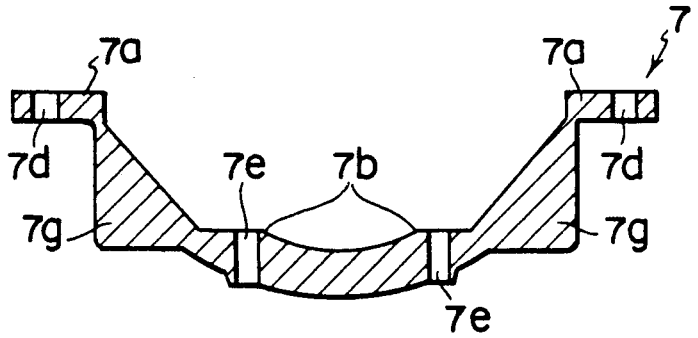
Figure 12:
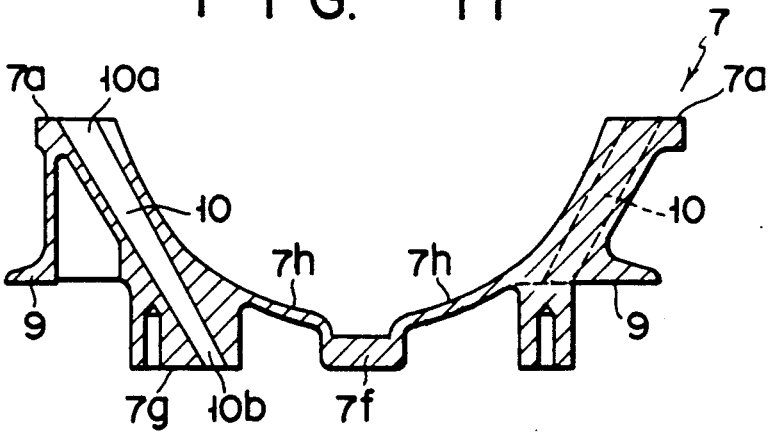

As seen from FIG. 4, the bottom wall 7*h* has a semi-cylindrical cross section and is located outside the locus of revolution of crank counter weights 24 and connecting rods 26 which are connected to the crankshaft 4. As shown in FIGS. 1 and 5, the outer periphery of the bottom wall 7*h* is provided with a plurality of reinforcing ribs 21 so that each pair of the ribs 21 are located on both sides of the corresponding fixing bolt 20B. Each reinforcing rib 21 extends from the fixing flange 7*a* to the side rib 7*g* such that sufficient rigidity against the extension and compression is ensured at the portions between the points a and b, between b and c, and between c and d.

In the areas of the bottom wall 7*h*, surrounded by the ribs 7*g* and 7*f* and located between the partition walls 7*b*, are formed rectangular opening 7*i* which are used for attaching an detaching the connecting rods 26 and for dropping oil in a crank chamber into an oil pan 8. The rectangular openings 7*i* allow the oil flowing out the crank metals to be returned to the oil pan 8 without stirring the oil in the crank chamber. This prevents the oil from being mixed with air bubbles. By removing the oil pan 8, the connecting rod caps and metals can be mounted and removed without detaching the lower case 7 from the block 1. On the undersurface of the lower case 7 is provided an oil pan rail 9 to which the oil pan 8 is attached.

The oil pan 8 will be explained with reference to FIGS. 13 and 14.

Figure 13:
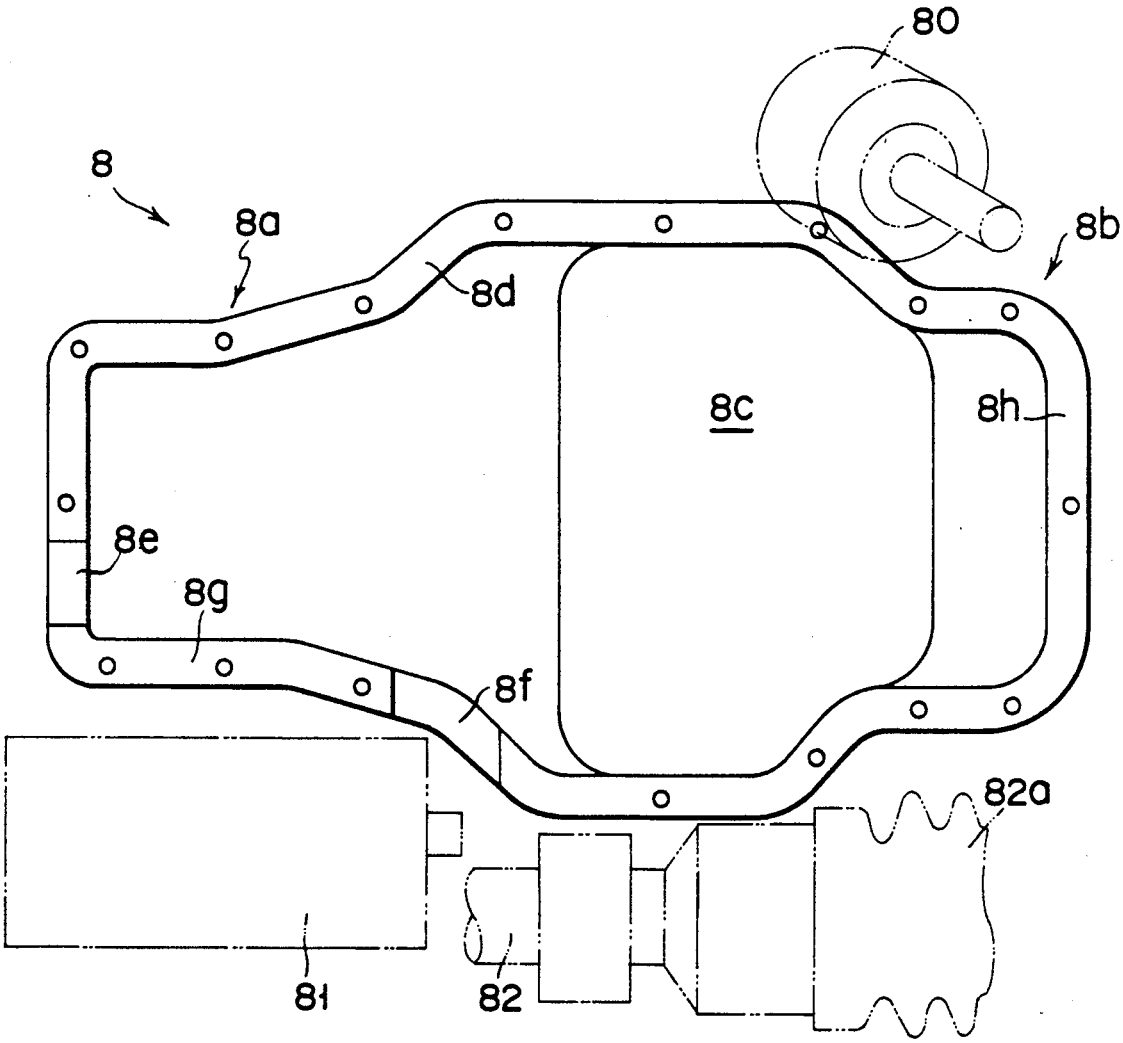
Figure 14:
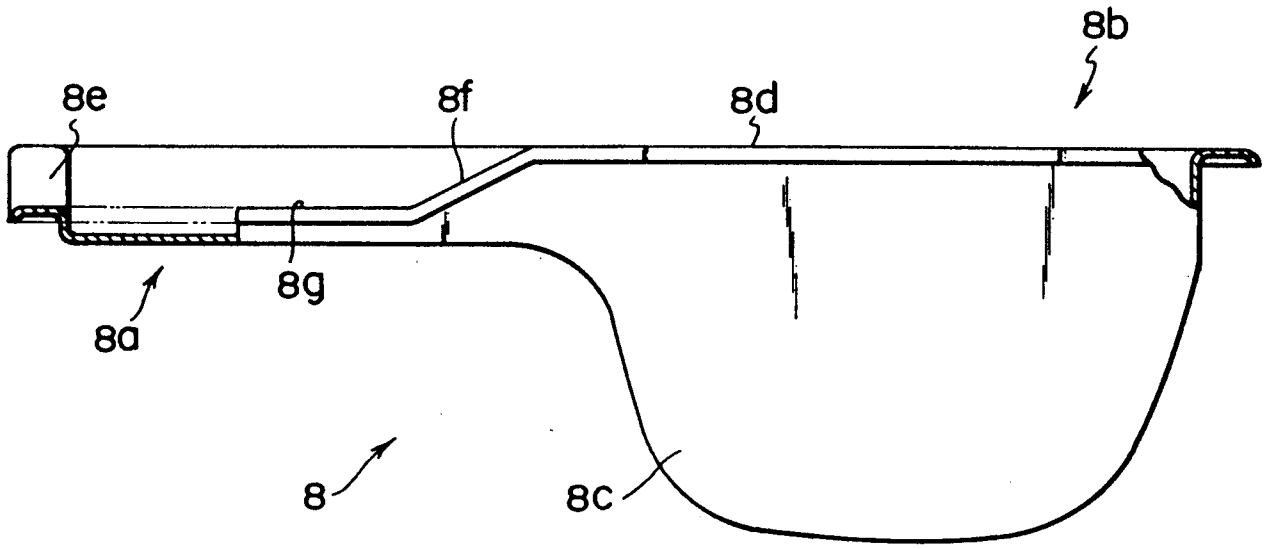

When viewed from the top as shown in FIG. 13, the oil pan 8 has a top opening and a flange 8*d* extending along the edge of the opening. The oil pan 8 has narrow front and rear portions 8*b* and 8*a*, and a wide central portion disposed closer to the front portion 8*b*. Further, when viewed from the lateral side as shown in FIG. 14, the rear portion 8*a* of the oil pan 8 is formed shallow, because the rear portion 8*a* functions only as a receiver of the oil falling from the rectangular openings 7*i* of the lower case 7. The front portion 8*b* is deep so as to constitute an oil reservoir 8*c*. A portion 8*g* of the flange 8*d* of the oil pan 8 is lower than the remaining portion. The lower portion 8*g* is connected to the remaining higher portion by inclined portions 8*e* and 8*f* so that the flange 8*d* has a stepped structure. Since the rear end portion 8*a* of the oil pan 8 is formed narrow, the auxiliary members such as an oil filter 80 and a starter motor 81 and, the driving members such as a drive shaft 82 having boots 82*a* can be easily laid out in an engine room, as shown in FIG. 13.

As shown in FIGS. 3 through 9, the oil rail 9 of the lower case 7 is formed so as to conform to the configuration of the flange 8*d*, 8*f* and the inclined portions 8*e*, 8*f* of the oil pan 8, and thus has inclined portions 9*a* and 9*b*, and a lowered portion 9*c* formed therebetween. Screw holes 9*d* are bored in the rail 9 and fixing screws passing through the flange 8*d* of the oil pan 8 are screwed into the holes 9*d*.

As shown in FIG. 2 and FIGS. 4 through 12, a plurality of oil passages 10 are formed in the bottom wall 7*h*. The passages 10 extend in the circumferential directions of the bottom wall 7*h* on the both sides of the crankshaft 4 and are separated apart from one another in the axial direction of the crankshaft 4.

The upper end 10*a* of each passage 10 opens to the flange 7*a*. The upper end 10*a* communicates with the lower end of an oil dropping hole 1*b* or 1*c* which is formed in the cylinder block 1 and through which the oil is conducted from a moving valve system (not shown). The lower end 10*b* of the passage 10 opens to the outside of the bottom wall 7*h* such that the oil directly flows down into the oil pan 8 without passing through the area wherein the counter weights 24 and the connecting rods 26 rotate. However, among the two rows of the passages 10 arranged on the both sides of the crankshaft 4, only the oil passage 10A located at the rear end of one row opens to the upper side of the bottom wall 7*h*, because its lower end 10Ab cannot open to an area above the oil pan 8 due to the limitation occurring from the positional relationship between the oil pan rail 9 and the lower end 10Ab of the passage 10A. The last oil passage 10B of the other row is arranged at the same position at that of the passage 10A with respect to the lengthwise direction of the cylinder block 1. However, since, as described above, the oil pan rail 9 has the lowered portion 9*c*, the lower end of the passage 10B opens to the lower side of the bottom wall 7*h*. As shown in FIG. 4, the connecting rods 26 is rotated in the direction indicated by an arrow a, and the oil passage 10A is located on the upstream side of the oil passage 10B with respect to the rotational direction a of the connecting rods 26. In other word, if the lowered portion 9*c* of the oil pan rail 9 is formed on the downstream side of the remaining higher portion of the oil pan rail 9 with respect to the rotational direction a, the oil can be directly conducted from the cylinder block 1 to the oil pan 8 without passing through the bottom wall 7*h*. Therefore, since the most oil returns from the block 1 to the oil pan 8 without passing through the crank chamber, the oil falls into the oil pan 8 very smoothly. Further, the oil returns to the oil pan 8 without being stirred in the block 1 and the crank chamber, whereby the oil is prevented from being mixed with air bubbles, and is not first degraded.

Figure 2:
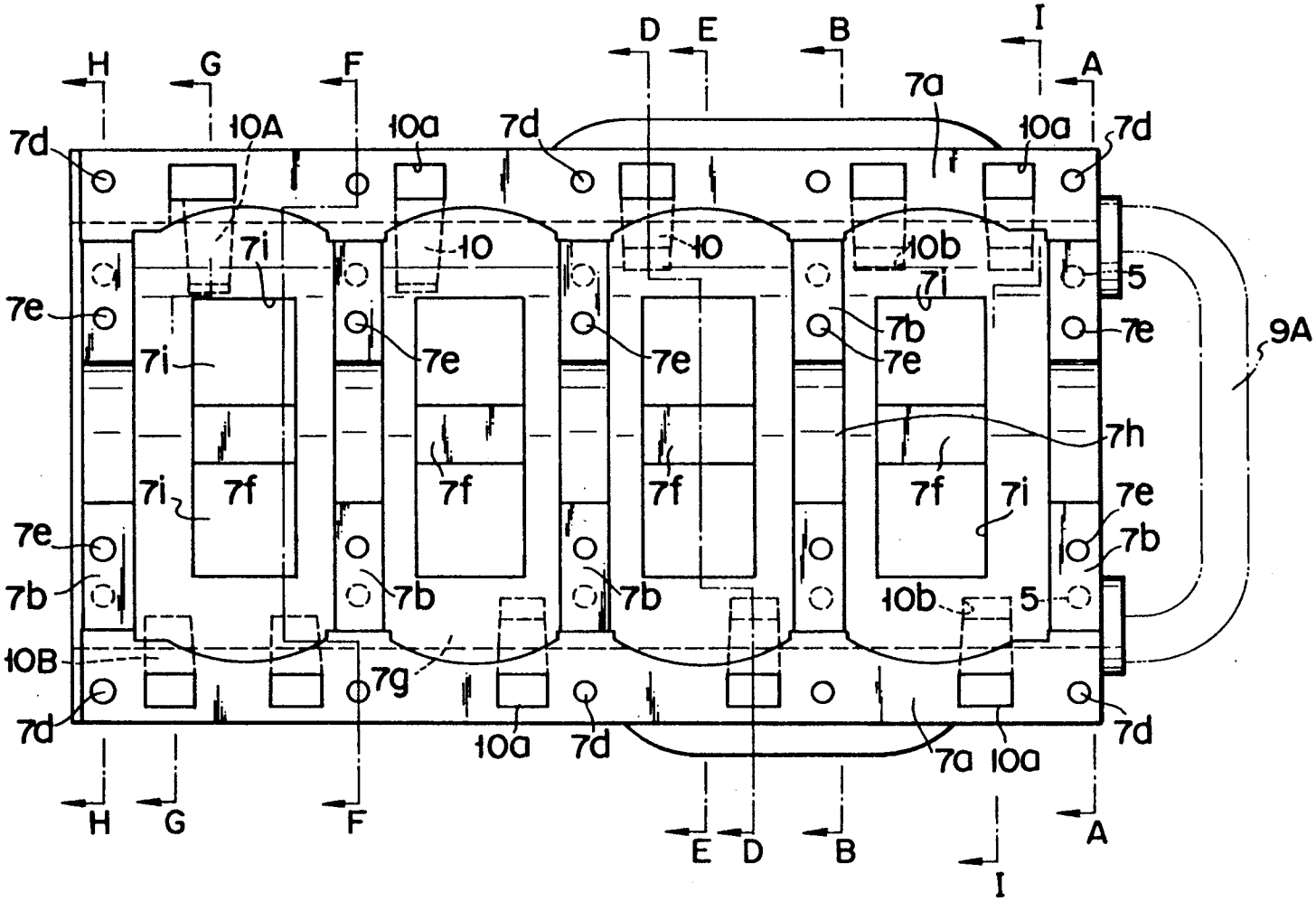
Figure 3:
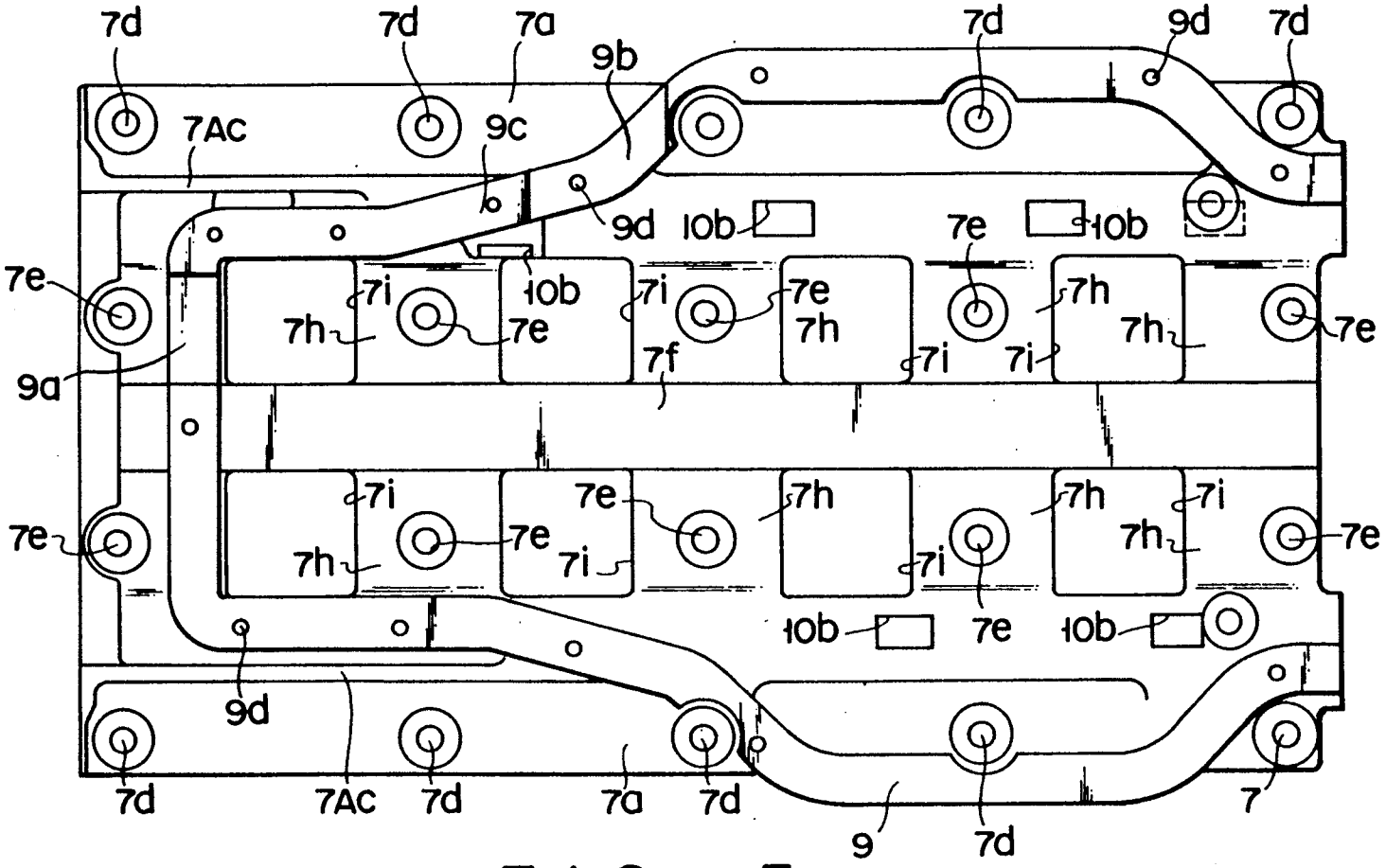

In FIG. 2, a chained line 9A represents an oil pan rail of a front cover (not shown) which is mounted on the front ends of the cylinder block 1 and the lower case 7. The rail 9A is flush with the oil pan rail 9 and is connected to the front flange 8*h* of the oil pan 8.

Figure 15:
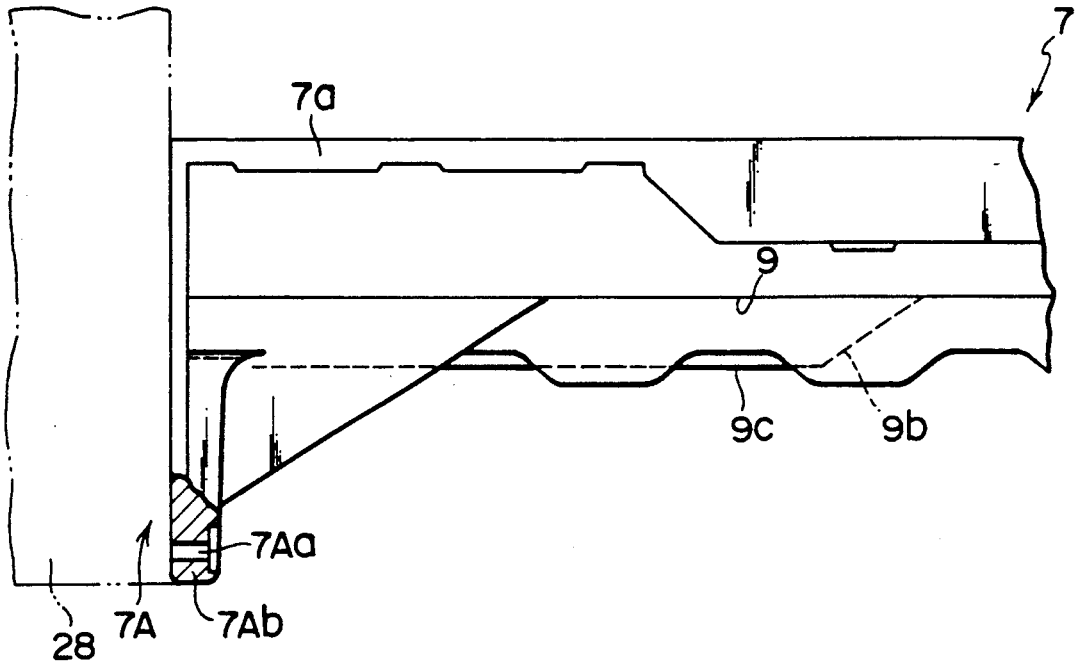
Figure 16:
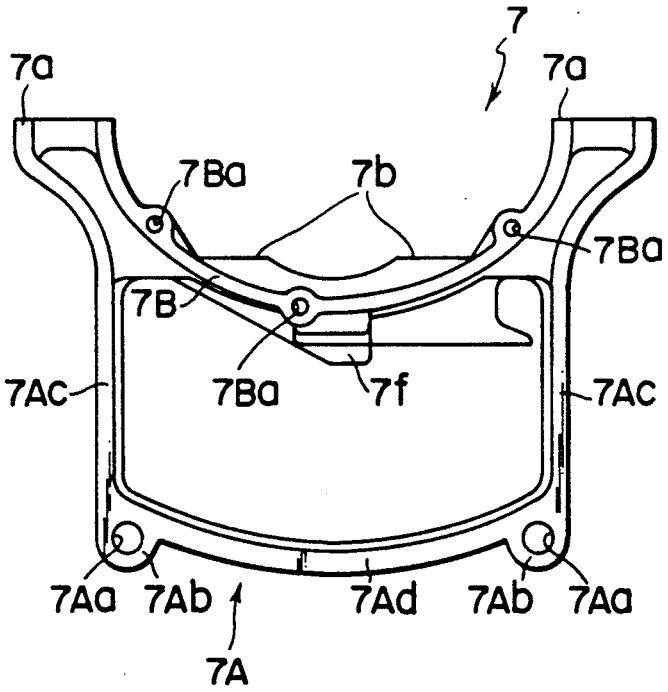

As shown in FIGS. 15 and 16, the rear end portion of the lower case 7 has a case extension 7A connected by means of bolts to a suitable portion of the housing of a transmission 28. The case extension 7A is located outside of the oil pan rail 9 and has boss portions 7Ab formed with holes 7Aa for fixing bolts and a connecting portion 7Ad which connects the boss portions 7Ab. Plate-like reinforcing ribs 7Ac extend from the side ribs 7*g* and are coupled to the boss portions 7Ab. Accordingly, the rigidity against the upward and downward bending of the power plant is effectively increased without using separate reinforcements. If the rear end face of the lower case 7 is expanded to the extent in which the end face of the housing of the transmission 28 extends, it is unnecessary to provide a rear plate, which is required in a conventional cylinder block, at the lower portion of the rear end face of the cylinder block 1, and a low noise structure with no membranous vibration can be obtained.

Generally, as shown in FIGS. 17A to 17D, on the rear end portion of the crank shaft 4 is provided an oil seal case 102 for holding a rear oil seal 100 which seals the crankshaft 4. In an engine unit, a seal for S the seal case 102 itself is commonly used to seal the mating faces between the seal case 102, an oil pan 8' and an cylinder block 1', so that the seal is not easily assembled into the engine unit.

With the conventional structure, the rear portion 8*i* of an oil pan edge portion 8*d'* for fixing an oil pan 8' to the cylinder block 1' is drawn toward the crank shaft 4' such that the width of the rear portion 8*i* become narrower. The seal case 102 is placed at its undersurface 102*a* on the rear portion 8*i* and held thereon. Further, the amount of the drawing of the pan edge portion 8*d'* is limited by the width T of the cap 3'.

Figure 17A:
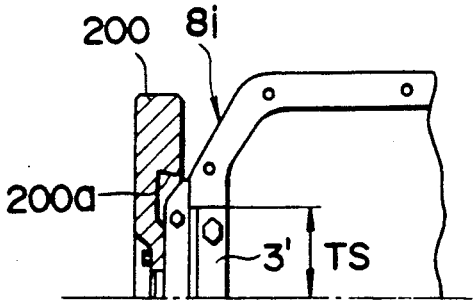
FIG. 17A (PRIOR ART)

As the output of an engine with a small capacity is not so large, it is sufficient to use only two fixing bolts to fix the cap 3' to the crank journal 2'. Thus, as shown in FIG. 17A, the cap width 2TS may be small. It means that the oil pan edge portion 8*d'* can be drawn closely to the crank shaft 4', permitting the use of the seal case 102 having a narrow width. As a result, the seal case 102 can be disposed in a recess 200*a* formed in a flywheel 200 arranged between the engine and a transmission 28'. This structure is applied to a vehicle provided with a manual transmission (M/T vehicle). For a vehicle equipped with the an automatic transmission (A/T vehicle), the seal case 102 can be housed in a space defined between the bolts for connecting the drive plate (not shown) to the torque converter (not shown).

Figure 17B:
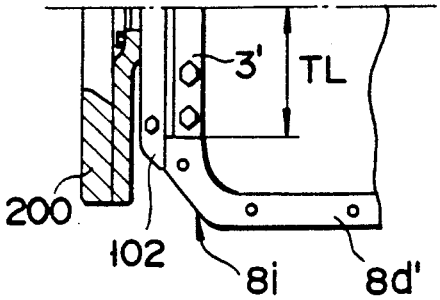
FIG. 17B (PRIOR ART)
Figure 17D:
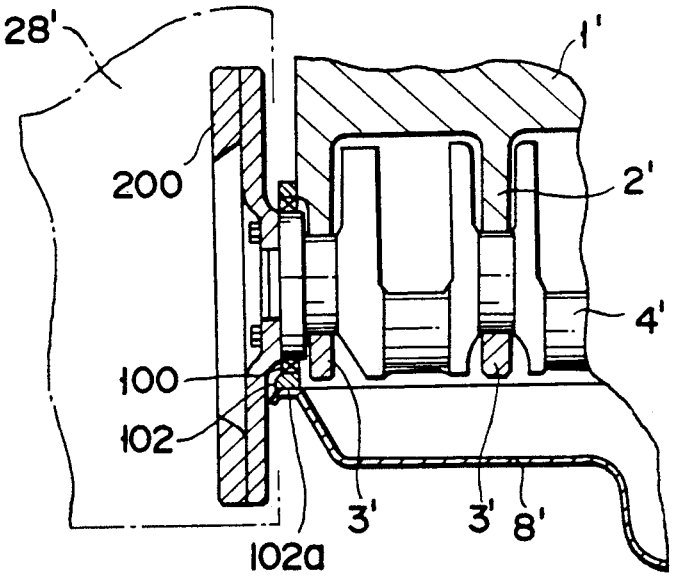
FIG. 17D (PRIOR ART)
Figure 17C:
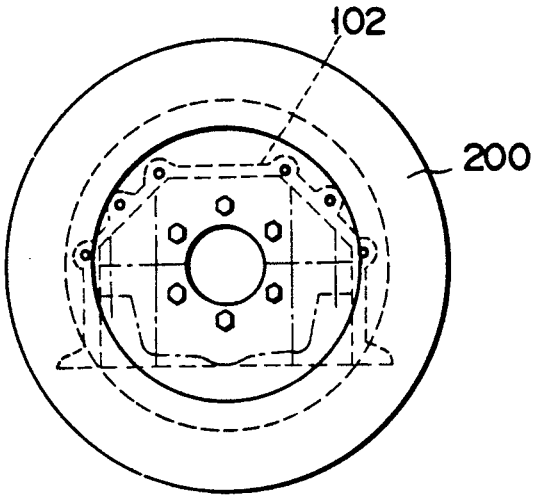
FIG. 17C (PRIOR ART)
Figure 18A:
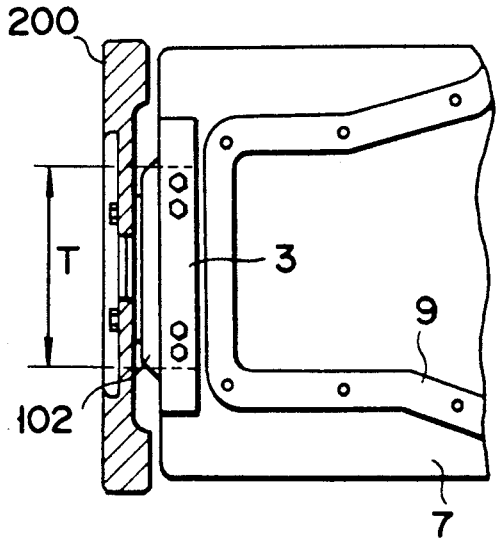
Figure 18C:
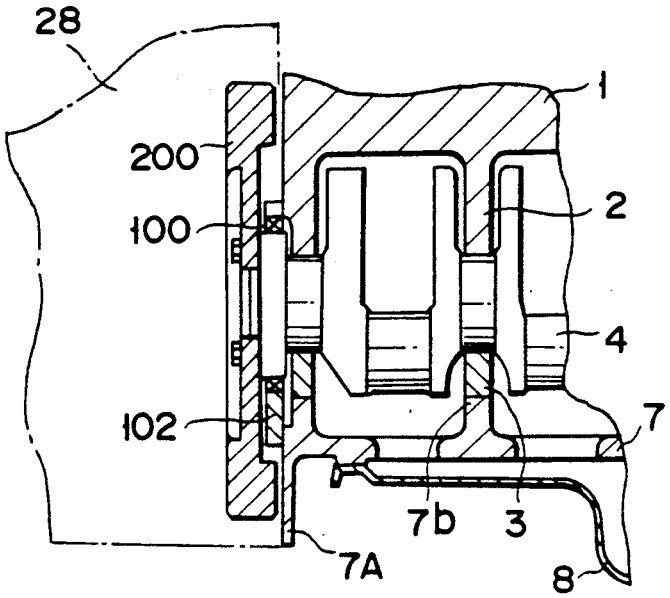
Figure 18B:
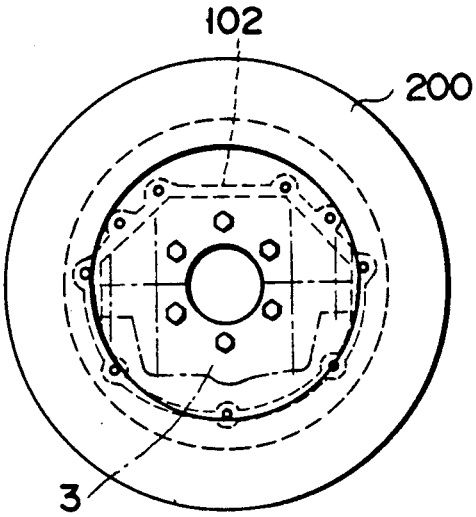

As the output of an engine with a large capacity becomes larger, the cap 3' must be fixed to the rank journal 2' by four fixing bolts, making the cap width 2TL larger than that of the engine with a small capacity, as shown in FIG. 17B. Thus, the amount of drawing of the oil pan edge portion 8*d'* is rendered small and thus a seal case 102 having a large width must be used. Accordingly, for an M/T vehicle, the seal case 102 cannot be housed in the recess 200*a* formed in the flywheel 200, causing a problem that the overall length of the engine is larger by the thickness of the seal case 102 than that with a small capacity. For an A/T vehicle, the seal case 102 cannot be placed in the space defined between the fixing bolts.

Since the flywheel 200 must have some degree of moment of inertia, the diameter of the depress 200*a* cannot make large so as to accord with the case width. Further, it is difficult to change the positions of the fixing bolts for fixing the drive plate to the torque converter under the structural limitation.

However, according to the engine unit of the embodiment has the lower case 7 fixed to the lower portion of the cylinder block 1 and the oil pan 8 fixed to the lower portion of the lower case 7, As shown in FIGS. 16 and 18A to 18C, on the rear end portion of the lower case 7 is formed a rail 7B to which the lower half of the oil seal case 200 is fixed. The upper half of the oil seal case 200 is connected to the cylinder block 1. Bolt holes 7Ba for fixing the case 30 are bored in the rail 7B. In this case, the boundary face (the rail 7B) between the case 200 and the lower case 7 is independent from the boundary face (the oil pan rail 9) between the oil pan 8 and the lower case 7. Thus, the seal of the oil seal case 200 can be independently provided from the seal between the oil pan 8 and the lower case 7. Thus, the sealing effect and the easiness of assembling of the engine unit can be greatly improved. Further, because it is unnecessary to make the seal case 102 larger as the width T of the cap 3 is increased, it is possible to house the seal case 102 in the depress 200*a* formed in the flywheel 200 with case. Moreover, for an A/T vehicle, the seal case 102 can be placed in the space defined between the fixing bolts, whereby the overall length of the engine unit can be made small as compared with the conventional engine unit with a large capacity.

With the engine unit according to this invention, the partition walls of the lower case abut against the lower surface of the main bearing caps fixed to the crank journals by the bolts, and the lower case is fastened to the cylinder block with being lapped over the main bearing caps, by the fixing bolts 5 screwed into the block 1 from the underside of the lower case passing through the partition walls and the main bearing caps. With this structure, the distance between the fitting face of the crank journal, to which the cap is fitted, fitted into the cap and the partition wall of the lower case can be large, thereby decreasing the moment of inclination acting on the caps. This enables the angle of inclination of the caps to be decreased, thereby increasing the rigidity of the main cap greatly. Since the main cap is not embedded in the lower case but is connected thereto by the bolts, the cylinder block can be easily produced.

Additional advantages and modifications will readily occur to those skilled in the art. Therefore, the invention in its broader aspects is not limited to the specific details, representative devices, and illustrated examples shown and described. Accordingly, departures may be made from such details without departing from the spirit or scope of the general inventive concept as defined by the appended claims and their equivalents.

What is claimed is:

1. An engine unit in which a crankshaft is rotably arranged, comprising:

a cylinder block including a pair of side walls extending parallel to said crankshaft, with said crankshaft between said side walls, a pair of first flanges formed on lower edges of the side walls, a plurality of first partition walls arranged between said side walls and connecting said first flanges to each other, and a plurality of crank journals formed on lower edges of said first partition walls and each receiving said rotatable crankshaft;

a lower case fixed to said cylinder block and covering said crankshaft, said lower case including a substantially semicylindrical bottom wall located outside of a locus of rotation of said crankshaft and having a pair of side edges extending in parallel to the axis of the crankshaft, a pair of second flanges formed on said side edges of the bottom wall and abutting against said first flanges, and a plurality of second partition walls formed on said bottom wall and opposing and associtated with said first partition walls, respectively;

a plurality of bearing caps holding said rotatable crankshaft in cooperation with said crank journals, each of said bearing caps clamped between said associated first partition wall and second partition wall; and a plurality of fixing means for fixing said lower case to said cylinder block, each of said fixing means having a pair of first fastening members fastening said associated first partition wall and second partition wall and said bearing cap clamped between the first and second partition walls together, and a pair of second fastening members each fastening said first and second flanges to each other, each of said first fastening members extending from under the lower case into said first partition wall, passing through said bearing cap and second partition wall, said pair of first fastening members being located between said pair of second fastening members, each of said second partition walls having at least two contact portions which contact the bearing cap and through which said pair of first fastening members respectively extend, said crankshaft being located between said pair of first fastening members, and said first and second fastening member of each fixing means being arranged on a common plane perpendicular to said axis of said crankshaft.

2. An engine unit according to claim 1, wherein said cylinder block is made of aluminum, and said bearing cap is made of cast iron.

3. An engine according to claim 1, wherein each of said bearing caps has an engaging portion fitted to said crank journal, and each of said fixing means has third fastening members fastening said crank journal and said engaging portion of the bearing cap to each other.

4. An engine unit according to claim 1, wherein said bottom wall of said lower case has a plurality of opening formed between said second partition walls which allow access to said crankshaft.

5. An engine unit according to claim 1, which further comprises an oil pan fixed to said lower case for storing oil for lubricating the interior of said engine, and wherein said lower case is provided with oil passages fromed in said bottom wall so as to extend circumferentially thereof, and said cylinder block has oil holes formed in said side walls and communicating with said oil passages to introduce said oil to said oil pan through said oil passages.

6. An engine unit according to claim 1, wherein said lower case has an oil pan rail formed on a lower surface of said bottom wall, and which further comprises an oil pan including a top opening, an edge portion extending along the edge of the opening and fitted to said oil pan rail, and an oil reservoir for storing oil flowing out of said engine, said edge portion having a front end portion located on the other axial end side of said crankshaft, and a central portion between said front and rear end portions, said front and rear portions having a narrower width than said central portion, said front portion having a greater depth than the rear portion to thereby form said oil reservoir extending from said front portion to said central portion.

7. An engine unit according to claim 6, wherein said oil pan rail has a first portion, and a second portion arranged on the downstream side of said first portion with respect to the rotational direction of said crankshaft along said bottom wall and arranged at a position lower than said first portion.

8. An engine unit according to claim 1, wherein said lower case has a downwardly projecting extension, and which further comprises a transmission device to which a driving force of the engine is input, said transmission having a housing connected to said extension by means of bolts.

9. An engine unit according to claim 1, which further comprises an oil seal arranged on an output end of said crankshaft, and an oil scale case for holding said oil seal, and wherein said lower case has a case holding portion for holding said oil seal case.

* * * * *